US009121625B2

(12) United States Patent
Barcroft

(10) Patent No.: US 9,121,625 B2
(45) Date of Patent: Sep. 1, 2015

(54) ROOM VENTILATION SYSTEM AND APPARATUS

(71) Applicant: Victor N. Barcroft, North Barrington, IL (US)

(72) Inventor: Victor N. Barcroft, North Barrington, IL (US)

( * ) Notice: Subject to any disclaimer, the term of this patent is extended or adjusted under 35 U.S.C. 154(b) by 0 days.

(21) Appl. No.: 14/214,250

(22) Filed: Mar. 14, 2014

(65) Prior Publication Data

US 2014/0273802 A1 Sep. 18, 2014

Related U.S. Application Data

(60) Provisional application No. 61/789,192, filed on Mar. 15, 2013.

(51) Int. Cl.
*F24F 13/18* (2006.01)
*F24F 7/00* (2006.01)

(52) U.S. Cl.
CPC ..... *F24F 13/18* (2013.01); *F24F 2007/003* (2013.01); *Y10T 29/49826* (2015.01)

(58) Field of Classification Search
USPC ..... 454/284, 332, 271, 273, 286
See application file for complete search history.

(56) References Cited

U.S. PATENT DOCUMENTS

| | | | | |
|---|---|---|---|---|
| 755,973 | A * | 3/1904 | West | 454/273 |
| 1,136,784 | A | 4/1915 | Fair | |
| 1,185,193 | A | 5/1916 | Gold | |
| 1,273,288 | A | 7/1918 | Stein | |
| 1,331,397 | A | 2/1920 | Stein | |
| 1,360,698 | A | 11/1920 | Vorbroker | |
| 1,409,050 | A | 3/1922 | Jurisch | |
| 1,592,667 | A * | 7/1926 | Lewis | 454/132 |
| 2,322,590 | A | 6/1943 | Pickering et al. | |
| 2,751,839 | A | 6/1956 | Moore | |
| 2,769,386 | A | 11/1956 | Silvernail | |
| 2,789,493 | A * | 4/1957 | Riggle | 454/196 |
| 2,869,450 | A * | 1/1959 | Leigh | 454/288 |
| 3,509,812 | A | 5/1970 | James | |
| 3,727,539 | A * | 4/1973 | Wilmes | 454/324 |
| 3,804,157 | A * | 4/1974 | Wenig | 165/55 |
| 3,878,621 | A * | 4/1975 | Duerre | 34/90 |
| 4,182,487 | A * | 1/1980 | Eriksson | 236/49.5 |
| 4,404,187 | A | 9/1983 | Schwinn et al. | |
| 4,546,693 | A | 10/1985 | McTaw, Jr. | |
| 4,616,561 | A * | 10/1986 | Giocastro | 454/213 |
| 5,884,496 | A * | 3/1999 | Kim et al. | 62/186 |
| 7,128,643 | B2 * | 10/2006 | Beliveau et al. | 454/276 |

(Continued)

*Primary Examiner* — Steven B McAllister
*Assistant Examiner* — Frances F Hamilton
(74) *Attorney, Agent, or Firm* — Meroni & Mernoi, P.C.; Charles F. Meroni, Jr.

(57) ABSTRACT

A room ventilation system, apparatus, and method enable a user to selectively ventilate a room, and incorporate the use of a tubular vent assembly. The tubular vent assembly has an apertured outer tube construction, and an apertured inner tube construction. The outer tube construction has fixed apertures. Upper convex surfacing of the outer tube construction is fixedly attached to an upper assembly-fixing construction, and lower convex surfacing is fixedly attached to a lower assembly-fixing construction. The inner tube construction has rotatable apertures insofar as the inner tube construction is rotatable relative to the outer tube construction for aligning the rotatable apertures with the fixed apertures for selectively enabling an air current to pass intermediate the room interior and the room exterior for ventilating the room interior. A lever arm and a lever-letting slot provide the user with cooperable structure for selectively adjusting the rotatable apertures.

5 Claims, 8 Drawing Sheets

(56) References Cited

U.S. PATENT DOCUMENTS

| | | | | |
|---|---|---|---|---|
| 7,540,169 | B2 * | 6/2009 | Kwon | 62/407 |
| 2005/0011218 | A1 * | 1/2005 | Pearson et al. | 62/407 |
| 2007/0135034 | A1 | 6/2007 | Lack | |
| 2007/0161345 | A1 | 7/2007 | Chato | |
| 2010/0197214 | A1 | 8/2010 | Geremia, Sr. et al. | |
| 2010/0267326 | A1 | 10/2010 | Back | |

* cited by examiner

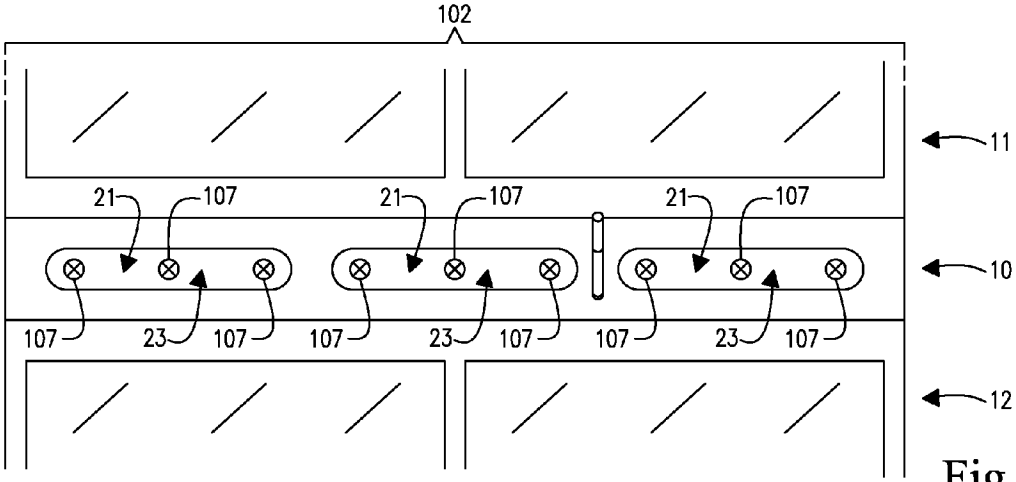
Fig. 8
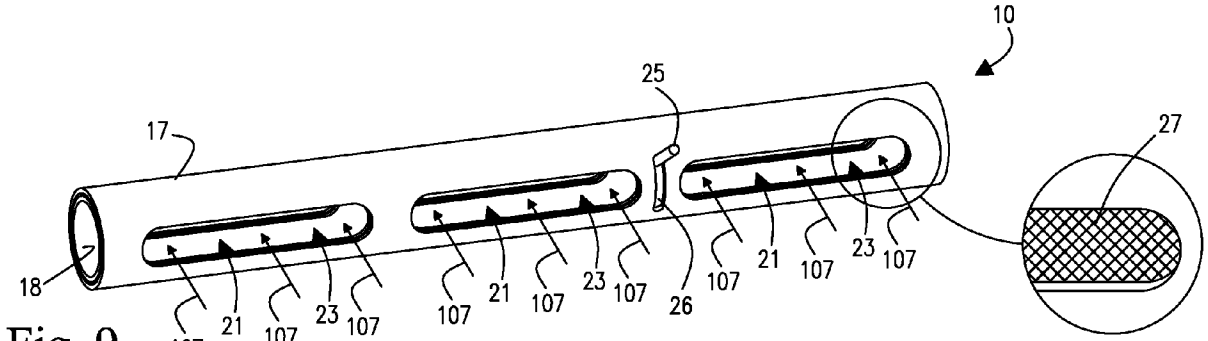
Fig. 9
Fig. 9A

ROOM VENTILATION SYSTEM AND APPARATUS

PRIOR HISTORY

This non-provisional patent application claims the benefit of U.S. Provisional Patent Application No. 61/789,192 filed in the United States Patent and Trademark Office on 15 Mar. 2013.

BACKGROUND OF THE INVENTION

1. Field of the Invention

The present invention relates generally to an assembly or apparatus for ventilating a room. More particularly, the present invention relates to a low cost room ventilation apparatus that operates via manual manipulation thereof for controlling airflow therethrough.

2. Brief Description of the Prior Art

Certain prior art generally related to the subject invention are briefly described hereinafter. U.S. Pat. No. 327,414 ('414 Patent), which issued to Scharnweber, for example, discloses a Ventilator. The '414 Patent describes a ventilator comprising, in combination, a chamber underneath the sill of a window, communicating through the top of the said sill with the interior of an apartment and provided with one or more openings leading to the exterior air, and means, substantially as described, for opening and closing and graduating the communication through the top of the sill with the interior of the said apartment, whereby the vertical flow of air in an upward direction into the said apartment and the flow therefrom may be regulated, or the flow wholly shut off.

U.S. Pat. No. 428,739 ('739 Patent), which issued to Abrahamson, discloses a Window Ventilator. The '739 Patent describes a window ventilator consisting of the combination of the casing, having slotted ends and oppositely-sliding ventilating plates or sheets fitted in said casing from and through opposite ends, whereby the whole device is rendered adjustable to different widths of window-casings.

U.S. Pat. No. 1,136,784 ('784 Patent), which issued to Fair, describes a Ventilating Window or Door. The '784 Patent describes a window of the character described, outer and inner sashes, a frame in which said sashes move, one member of the frame being hollow, and having communication with the outside air and with the space between said sashes, a damper pivotally mounted within the hollow member and controlling the passage of air thereinto, and damper actuated means extending out of the front of said hollow member.

U.S. Pat. No. 2,322,590, ('590 Patent), which issued to Pickering et al., describes a Window Ventilator. The '590 Patent describes a window ventilator comprising a frame adapted to be positioned between a window sash and its sill, spaced stationary members within the frame, said spaced stationary members having aligning openings, disposed within the space between the stationary members, the openings of the movable member adapted to align with the openings of the stationary members admitting air through the ventilator.

Wide downwardly inclined flanges extend forwardly from the frame and providing a hood, wide horizontally disposed shutter members pivotally mounted within the hood and disposed in spaced relation with the openings of the stationary members, said shutters being disposed in direct alignment with the openings of the ventilator, said shutters adapted to be adjusted to obstruct the passage of air through the aligning openings, and means for operating the shutters simultaneously.

U.S. Pat. No. 2,751,839 ('839 Patent), which issued to Moore, discloses a Ventilator for Storm Windows. The '839 Patent describes a ventilator for storm windows or the like, comprising: a fixed horizontally elongated vertically disposable sheet-materials panel having a plurality of ventilating openings therein; a slide panel of sheet material overlying and substantially co-extensive with said fixed panel and having ventilating openings therein of such sizes and positions as to register with the openings in said fixed panel in one relatively adjustable position of said panels, and to be out of registry therewith in another position thereof.

An upper strip of sheet material has its central portion overlying the upper edges of said panels proper, having an inner upturned flange attached to an extension of said fixed panel and forming a pane-engaging strip therewith, and having an outer downturned flange forming with said fixed panel of guide channel for said movable panel, tope of said central portion constituting a ledge for receiving the lower edge of said pane and a bridging and sealing putty wedge between itself and the lower outer face of said pane.

A lower strip of sheet material has a horizontal central portion underlying and supporting said movable panel, having an upturned flange forming with said fixed panel a guide channel for said movable panel, having a downturned flange connected to said fixed panel to constitute therewith an anchorage strip adapted to seat vertically against the pane seat of the window frame, and being of a thickness and height permitting a retaining and sealing bridging putty wedge to be formed between itself and the outer edge of said seat, whereby said ventilator can be installed during or after window fabrication.

U.S. Pat. No. 3,509,812 ('812 Patent), which issued to James, discloses Ventilators. The '812 Patent describes an adjustable ventilator comprising a plate-like back member having apertures of small size to provide, in effect, a fly screen, an aperture front member which is slidably mounted on an completely overlaps the back member through the range of sliding movement, the back member having on two opposite sides projecting tongues which engage in front of inwardly projecting lugs on side walls of the front member whereby to provide a sliding connection between the two members, and the back member having screw fixing holes of key-hole shape which are concealed by the front member and which enable the ventilator, when fixed to a support surface by means of fixing screws, to be removed from and refitted onto the support surface without removing the fixing screws.

U.S. Pat. No. 4,407,187 ('187 Patent), which issued to Homey, discloses an Air Control Device. The '187 Patent describes a device for use in conjunction with an air flow duct to control the flow of air through the duct. The device includes a body for being secured with respect to the duct and having a central aperture therethrough for allowing substantially unhampered flow of air from the duct therethrough, a stationary plate for covering the central aperture of the body and having a plurality of apertures therethrough for allowing substantially unhampered flow of air therethrough, and a movable plate for covering the stationary plate and having a plurality of apertures therethrough for selective alignment with the apertures through the stationary plate to allow metering of the flow of air therethrough.

U.S. Pat. No. 4,546,693 ('693 Patent), which issued to McTaw, Jr., discloses a Vent Window Assembly. The '693 Patent describes a vent window assembly or filter comprises a continuous channel frame mountable within an opening in a building for a door or window, or within an opening in a vehicle body at the side, roof or rear window area. A laminate consisting of a pair of transparent sheets of plastic material and an intermediate thin plastic screen is nested and retained within the frame. Each of the sheets has a plurality of vertically spaced rows of longitudinally spaced apertures therethrough of a dimension considerably larger than the screen apertures.

The apertures in the sheets are in alignment to permit flow of air therethrough, the screen restricting the flow of dirt particles and insects. A vent closure sheet of transparent material is slidably mounted within the frame snugly engaging one of the sheets having therein a corresponding series of similar apertures aligned with the sheet apertures and adjustable for progressively displacing its apertures relative to the laminate apertures for closing off the flow of air.

United States Patent Application No. 2007/0161345, which was authored by Chato, describes a vent or baffle assembly which may be used between the edge of a window and the edge of a recess along which the window can reciprocate, or may be used adjacent a doorway. The vent assembly may include longitudinally extending members, and spacing members, or blocks. The longitudinally extending members and the blocks may be assembly to form a unit having a tortuous internal passageway. The longitudinally extending members may provide structural sturdiness. Sound deadening materials may be applied along a portion or all of the passageway. The longitudinally extending members may be of the same profile, and may nest together in a symmetrical fashion.

It will be seen from a review of the foregoing in particular, and the field of room ventilation means in general that the prior art perceives a need for a room ventilation apparatus comprising a rotatably fixed, apertured outer tube construction and a rotatable, apertured inner tube construction made rotatable relative to the rotatably fixed apertured outer tube construction for enabling users thereof to selectively ventilate a room outfitted with the apparatus by aligning to greater or lesser degrees the apertures formed in the outer and inner tube constructions. Accordingly, the present invention provides a room ventilation apparatus of the foregoing type as summarized in more detail hereinafter.

SUMMARY OF THE INVENTION

The present invention essentially provides a room ventilation apparatus as typified or exemplified by the tubular vent assembly for enabling a user to selectively vent a room or space, which room ventilation apparatus is mountable in a room boundary structure such as a wall or window or door construction for enabling a user to selectively vent a room. The tubular vent assembly according to the present invention has an apertured outer tube construction, and an apertured inner tube construction.

The inner tube construction is rotatable relative to the outer tube construction. The outer tube construction comprises room-exterior-side fixed apertures and room-interior-side fixed apertures. The inner tube construction comprises room-exterior-side rotatable apertures and room-interior-side rotatable apertures. The inner tube construction is rotatable relative to the outer tube construction for aligning the rotatable and fixed apertures for enabling an air current to pass to/from the room interior to/from the room exterior for venting the room interior.

The room ventilation apparatus may further preferably comprise certain manually operable means for rotating the inner tube construction relative to the outer tube construction for selectively aligning or opening the tubular vent assembly apertures. In this regard, the outer tube construction comprises a lever-letting slot and the inner tube construction comprises a lever member. The lever member extends outwardly from the inner tube construction via the lever-letting slot for enabling the user to selectively align the rotatable apertures with the fixed apertures for increasing or decreasing air flow to/from the room interior to/from the room exterior.

The room ventilation apparatus may further preferably comprise certain aperture-filtering means cooperably associated with either the fixed or rotatable apertures for preventing matter from entering the inner space defined by the inner tube construction. The aperture-filtering means are preferably exemplified by screen structures that cover or extend across certain of the apertures formed in the tubular vent assembly.

The room ventilation apparatus according to the present invention may further preferably comprise certain thermal insulation means for preventing or slowing heat transmission to/from the room interior to/from the room exterior when the inner tube construction is in a closed state. The thermal insulation means are exemplified by an upper-exterior layer of material insulation and a lower-interior layer of material insulation. The upper-exterior and lower-interior layers of material insulation preferably comprise opposed parallel surfacing for enhancing air flow intermediate the room interior and the room exterior when the inner tube construction is in a vent-open state.

A room ventilation method according to the present invention is believed to further enable a user to selectively vent a room, and essentially comprises the initial step of forming an assembly-holding construction in a room boundary structure. The assembly-holding construction preferably comprises an upper tube-engaging assembly and a lower tube-engaging assembly.

The tubular vent assembly or apparatus may then be mounted in the assembly-holding construction, which tubular vent assembly has an apertured outer tube construction and an apertured inner tube construction. The outer tube construction is rotatively fixed relative to the assembly-holding construction and comprises room-exterior-side fixed apertures and room-interior-side fixed apertures.

The inner tube construction may then be selectively rotated relative to the outer tube construction. The inner tube construction comprises the mentioned room-exterior-side rotatable apertures and room-interior-side rotatable apertures. The rotatable and fixed apertures may be selectively aligned for enabling an air current to pass intermediate the room interior and the room exterior for venting the room interior.

The step of selectively rotating the inner tube construction relative to the outer tube construction may be performed manually. More particularly, the outer tube construction comprises a lever-letting slot, and the inner tube construction comprises a lever member. The lever member extends outwardly from the inner tube construction via the lever-letting slot, and the method may thus be said to further comprise the step of manually aligning the rotatable apertures with the fixed apertures for increasing or decreasing air flow from the room interior to the room exterior via the lever member.

The room ventilation method may further comprise the step of filtering air as it flows through the tube vent assembly or apparatus according to the present invention via certain aperture-filtering means cooperably associated with the inner tube rotatable apertures or outer tube fixed apertures or a combination thereof. The aperture-filtering means basically function to prevent matter (such as debris or insects) from entering the inner space defined by the tubular vent assembly or apparatus.

The room ventilation method may further comprise the step of preventing precipitation from contacting the tubular vent assembly or apparatus via certain precipitation vent-guarding means as exemplified the guard element. The vent-guarding means are preferably and cooperably associated with the room exterior and attached in adjacency to the assembly-holding construction.

The room ventilation method may further comprise the step of thermally insulating the tubular vent assembly or apparatus for preventing or slowing heat transmission intermediate the room interior and the room exterior when the inner tube construction is in a closed state. Airflow may be directed intermediate opposed parallel surfacing defined by the tubular vent assembly for enhancing air flow intermediate the room interior and room exterior when the inner tube construction is in a vent-open state.

BRIEF DESCRIPTION OF THE DRAWINGS

Other features and objects of my invention will become more evident from a consideration of the following brief descriptions of illustrations of the subject invention:

FIG. 8 is a reduced, fragmentary, elevational room interior view of a tubular vent assembly mounted within an assembly-holding or assembly-fixing construction according to the present invention showing the tubular vent assembly in a fully open state with a second or maximum degree of airflow in a first direction through the tubular vent assembly.

FIG. 9 is a reduced, top perspective view of a tubular vent assembly according to the present invention showing the tubular vent assembly in a fully open state with a second degree of airflow in a first direction through the tubular vent assembly.

FIG. 9A is an enlarged fragmentary perspective view enlarged from FIG. 9 to more clearly depict or show a screen element outfitted at the aperture site of the tubular vent assembly.

DETAILED DESCRIPTION OF THE PREFERRED EMBODIMENT AND METHODOLOGY

Figure 1:
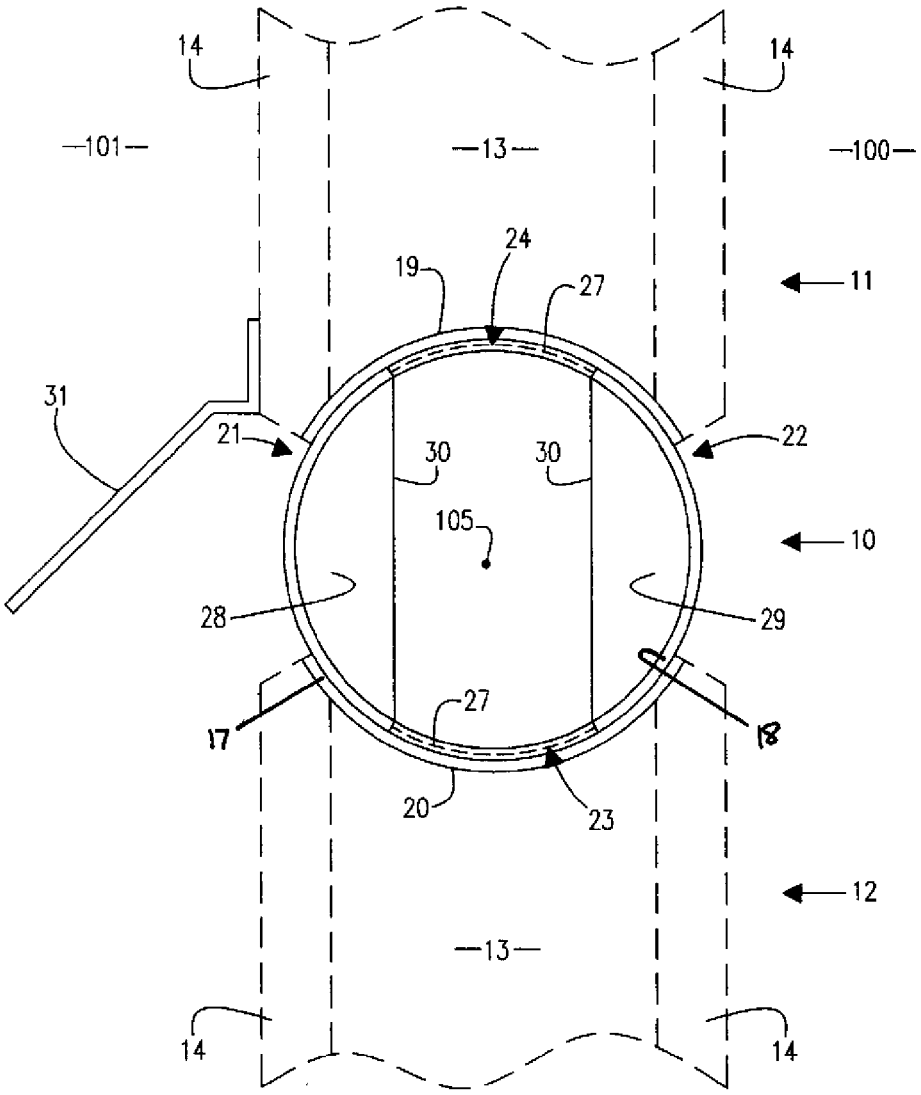
FIG. 1 is an enlarged, fragmentary, transverse longitudinal cross-sectional view of a tubular vent assembly mounted within an assembly-holding or assembly-fixing construction according to the present invention showing the tubular vent assembly in a closed state.

Referring now to the drawings with more specificity, the present invention essentially provides a room ventilation system, apparatus, and method for enabling a user to selectively vent a room outfitted with the basic apparatus 10 according to the present invention. Viewed systemically, the present invention is believed to provide a room ventilation system comprising, in combination a wall-based, assembly-holding construction (such as a window frame, wall, door jam or other boundary to a room) and the tubular vent assembly or apparatus as at 10.

The wall-based, assembly-holding construction basically functions to divide a room interior as at 100 from a room exterior as at 101. The wall-based, assembly-holding construction preferably comprises an upper tube-engaging assembly as at 11 and a lower tube-engaging assembly as at 12. The upper and lower tube-engaging assemblies 11 and 12 may be preferably formed by a series of structural members such as 2×4 timber(s) 13 and 1×4 timbers as at 14.

The upper tube-engaging assembly preferably comprises lower concave surfacing as at 15, and the lower tube-engaging assembly comprising upper concave surfacing as at 16, which surfacing 16 opposes the lower concave surfacing 15. The surfacing 15 and 16 preferably have uniform radii of curvature 103 and are concentric so as to extend in a circular formation in space about a center point 104 for receiving the cylindrical tubular vent assembly or apparatus 10.

The cylindrical tubular vent assembly or apparatus 10 preferably comprises an apertured outer tube construction as at 17, an apertured inner tube construction as at 18, and a vent assembly length as at 102. The apertured inner tube construction 18 is rotatable relative to the apertured outer tube construction 17 about an axis of rotation 105. When installed in the assembly-holding construction, the axis of rotation 105 of the tubular vent assembly or apparatus 10 is coaxial with the center point 104.

The apertured outer tube construction 17, being circular in transverse cross-section, has upper convex surfacing as at 19 and lower convex surfacing as at 20. The apertured outer tube construction 17 further preferably comprises a series of room-exterior-side, fixed apertures as at 21, and a series of room-interior-side, fixed apertures as at 22. The upper convex surfacing 19 of the apertured outer tube construction 17 is fixedly attached to the lower concave surfacing 15 of the upper tube-engaging assembly 11, and the lower convex surfacing 20 of the apertured outer tube construction 17 is fixedly attached to the upper concave surfacing 16 of the lower tube-engaging assembly 12.

The apertured inner tube construction 18 is also circular in transverse cross-section and preferably comprises room-exterior-side rotatable apertures as at 23 and room-interior-side rotatable apertures as at 24. As stated, the apertured inner tube construction 18 is rotatable relative to the apertured outer tube construction 17 for aligning the room-exterior-side rotatable apertures 23 with the room-exterior-side fixed apertures 21 and for simultaneously aligning the room-interior-side rotatable apertures 24 with the room-interior-side fixed apertures 22.

Figure 2:
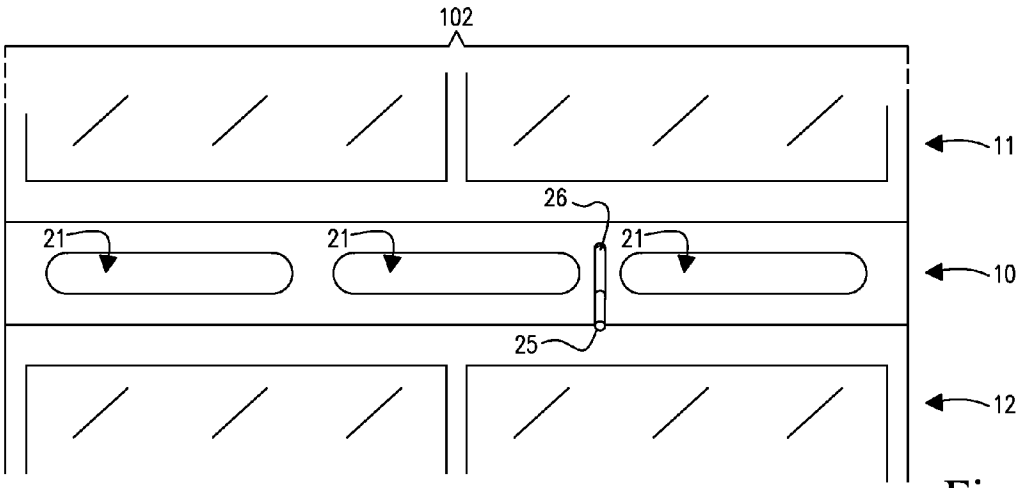
FIG. 2 is a reduced, fragmentary, elevational room interior view of a tubular vent assembly mounted within an assembly-holding or assembly-fixing construction according to the present invention showing the tubular vent assembly in a closed state.
Figure 3:
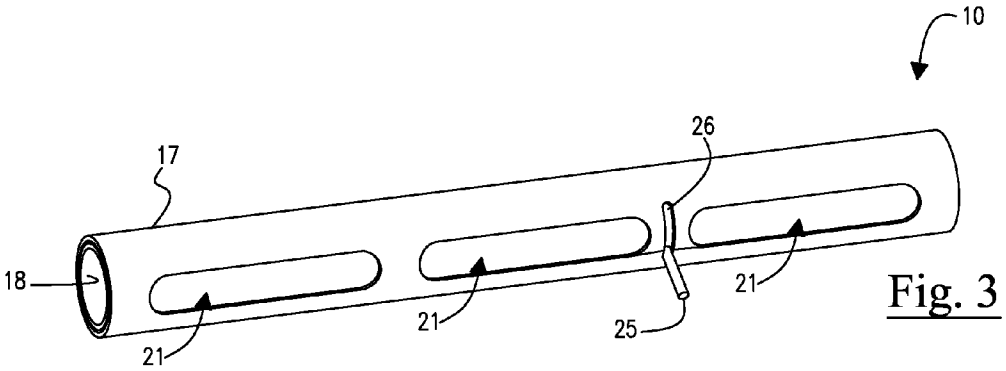
FIG. 3 is a reduced, top perspective view of a tubular vent assembly according to the present invention showing the tubular vent assembly in a closed state.
Figure 4:
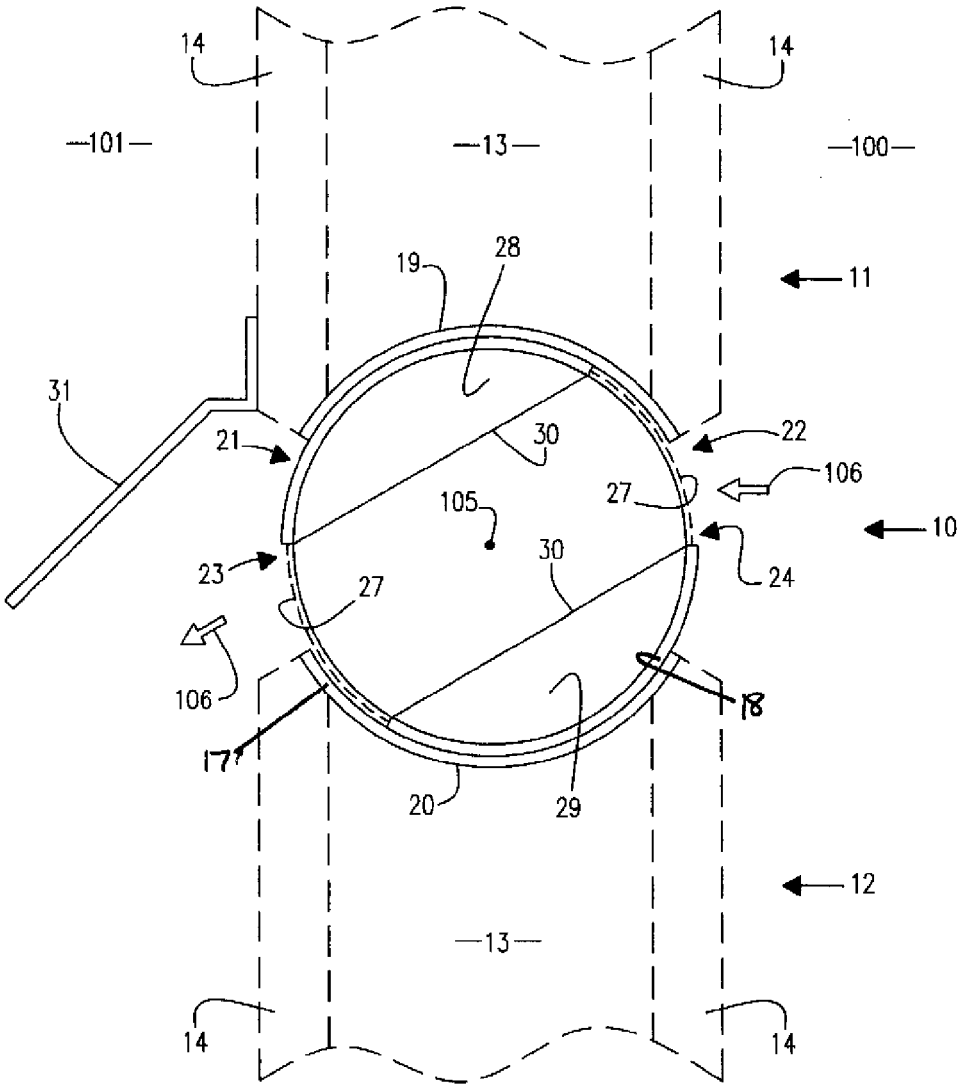
FIG. 4 is an enlarged, fragmentary, transverse longitudinal cross-sectional view of a tubular vent assembly mounted within an assembly-holding or assembly-fixing construction according to the present invention showing the tubular vent assembly in a partially open state with a first degree of airflow in a first direction through the tubular vent assembly.
Figure 5:
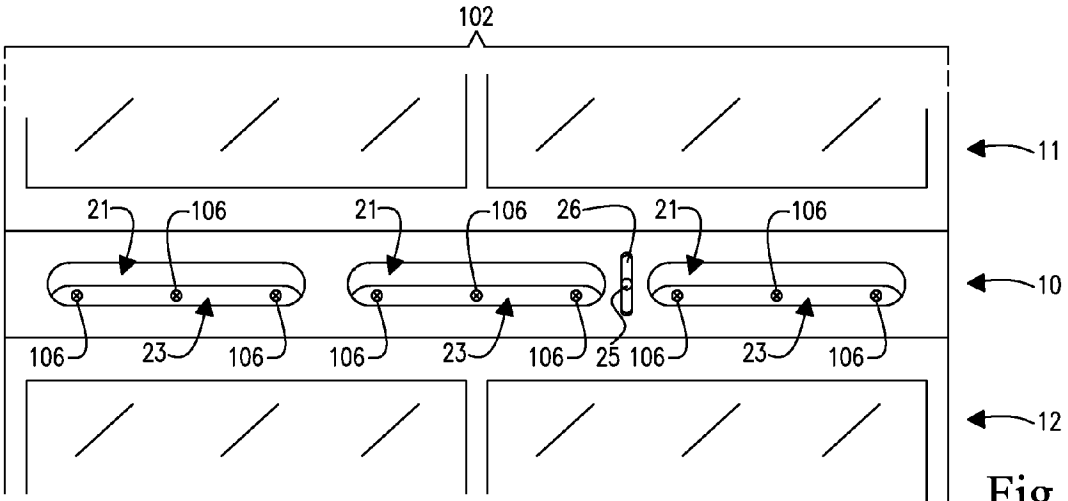
FIG. 5 is a reduced, fragmentary, elevational room interior view of a tubular vent assembly mounted within an assembly-holding or assembly-fixing construction according to the present invention showing the tubular vent assembly in a partially open state with a first degree of airflow in a first direction through the tubular vent assembly.
Figure 6:
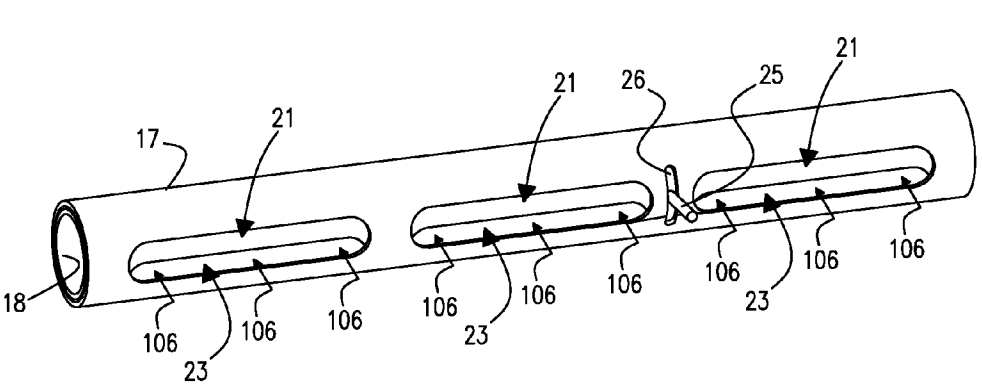
FIG. 6 is a reduced, top perspective view of a tubular vent assembly according to the present invention showing the tubular vent assembly in a partially open state with a first degree of airflow in a first direction through the tubular vent assembly.
Figure 7:
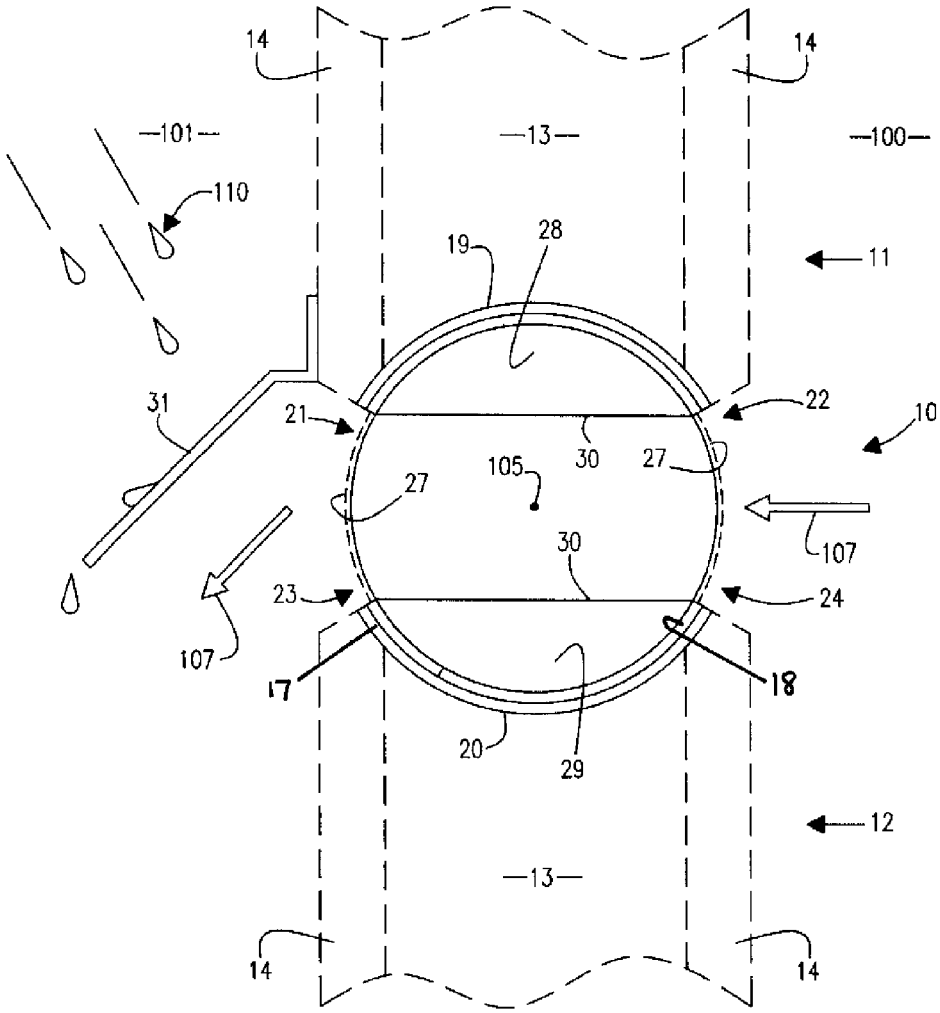
FIG. 7 is an enlarged, fragmentary, transverse longitudinal cross-sectional view of a tubular vent assembly mounted within an assembly-holding or assembly-fixing construction according to the present invention showing the tubular vent assembly in a fully open state with a second or maximum degree of airflow in a first direction through the tubular vent assembly.

Comparatively referencing FIGS. 1-3 versus FIGS. 4-6 versus FIGS. 7-9 the reader will note that FIGS. 1-3 depict a closed tubular vent assembly 10 or a structural configuration whereby the rotatable apertures 23 and 24 are out of alignment with the fixed apertures 21 and 22, and thus no air movement is possible through the tubular vent assembly or apparatus 10. FIGS. 4-6, by comparison, depict a partially open tubular vent assembly 10 or a structural configuration whereby the rotatable apertures 23 and 24 are in partial alignment with the fixed apertures 21 and 22, and thus a first degree of air movement is made possible through the tubular vent assembly or apparatus 10. The first degree of air movement is depicted at first vectors 106.

FIGS. 7-9, by further comparison, depict a fully open tubular vent assembly 10 or a structural configuration whereby the rotatable apertures 23 and 24 are in full alignment with the fixed apertures 21 and 22, and thus a second or maximum degree of air movement is made possible through the tubular vent assembly or apparatus 10. The second or maximum degree of air movement is depicted at second vectors 107. Second vectors 107 are longer than first vectors 106 for depicting relatively enhanced air movement in the full aperture alignment scenario as compared to the partial aperture alignment scenario.

Figure 10:
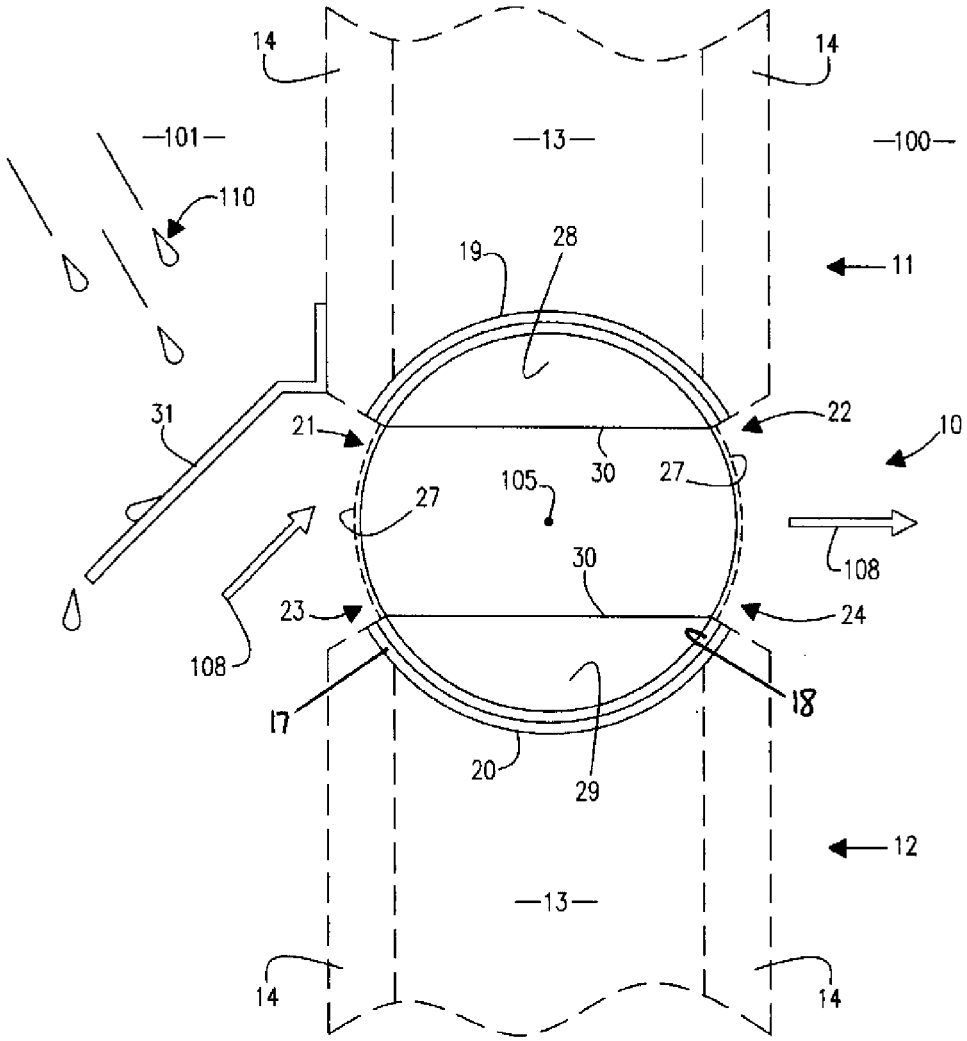
FIG. 10 is an enlarged, fragmentary, transverse longitudinal cross-sectional view of a tubular vent assembly mounted within an assembly-holding or assembly-fixing construction according to the present invention showing the tubular vent assembly in a fully open state with a second or maximum degree of airflow in a second direction through the tubular vent assembly.
Figure 11:
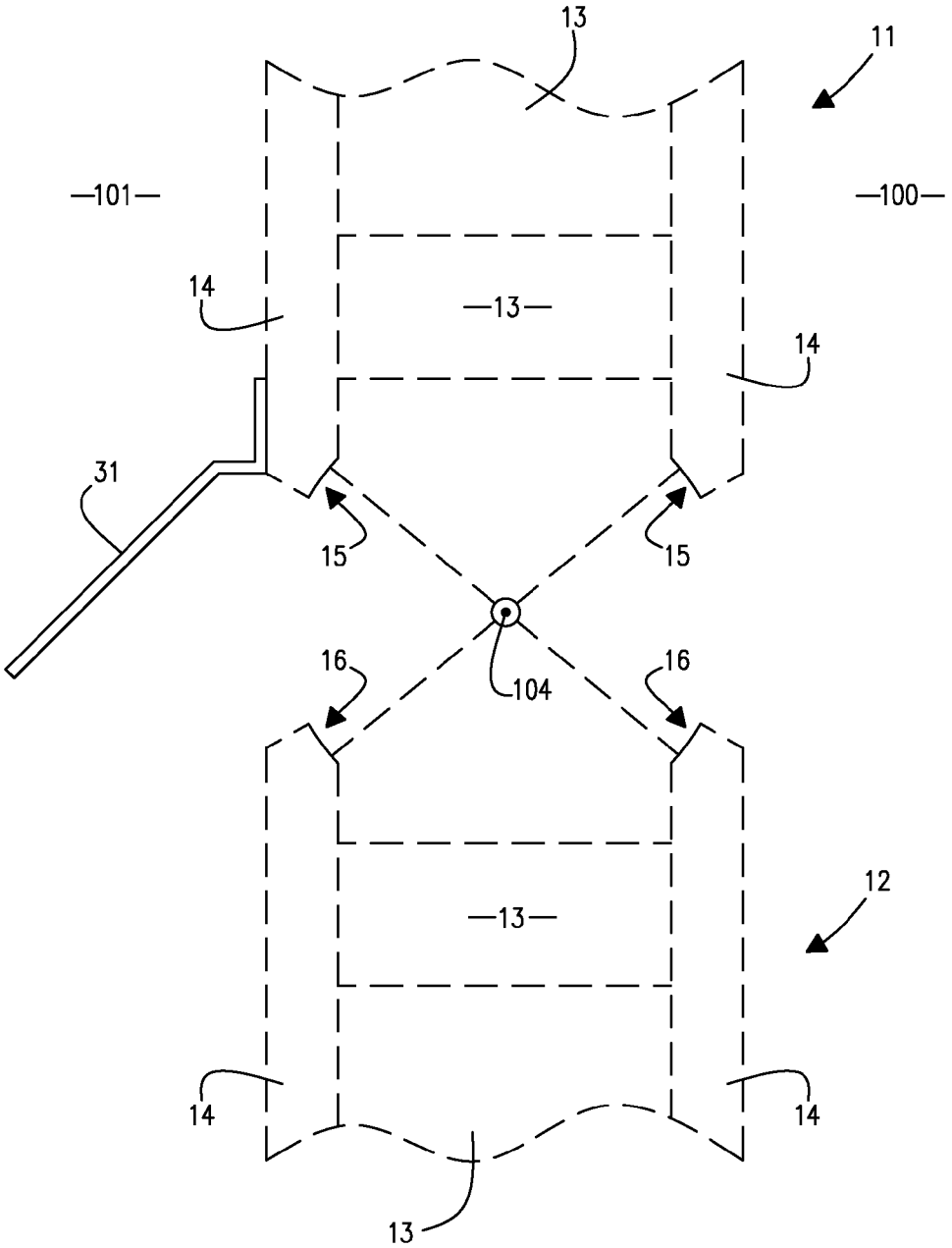
FIG. 11 is an enlarged, fragmentary, transverse longitudinal cross-sectional view of an assembly-holding or assembly-fixing construction showing upper and lower concave surfacing for receiving the convex outer surfacing of a tubular vent assembly according to the present invention.

Comparing FIG. 10 to FIG. 9, the reader will further note that third vectors are indicated at 108. The third vectors 108 are similar in size to second vectors 107, but reversed in direction as compared to second vectors 107 to depict a reversed air flow as may be evident, for example, when the air pressure in the room interior 100 is lower than the pressure in the room exterior 101 thereby causing air flow into the room interior 100 from the room exterior 101.

It will thus be understood that the tubular vent assembly or apparatus 10 and the selective aperture alignment described hereinabove enables an air current to pass to/from the room interior 100 to/from the room exterior 101 for venting the room interior 100 to/from the room exterior 101. To achieve the selective aperture alignment, the tubular vent assembly or apparatus 10 preferably further comprises certain manually operable means for rotating the apertured inner tube construction 18 relative to the apertured outer tube construction 17 for selectively aligning the rotatable apertures 23 and 24 with the fixed apertures 21 and 22.

In this last regard, it is contemplated that the manually operable means for rotating the apertured inner tube construction 18 relative to the apertured outer tube construction 17 may be preferably exemplified by a lever member 25 cooperable with a lever-letting slot 26. The lever-letting slot 26 is formed in the apertured outer tube construction 17 and the lever member 25 extends outwardly from the apertured inner tube construction 18 via the slot 26. The lever member 25 enables the user to selectively align the rotatable apertures 23 and 24 with the fixed apertures 21 and 22 for increasing or decreasing air flow to/from the room interior 100 to/from the room exterior 101. The apertured inner tube construction 18 may further preferably comprise or be outfitted with certain aperture-filtering means cooperably associated with the rotatable apertures 23 and/or 24. In this regard, it is contemplated that the aperture-filtering means basically function to prevent matter from entering the space within the apertured inner tube construction 18. The aperture-filtering means may be preferably exemplified by screen structures as at 27, which screen structures 27 extend across the rotatable apertures 23 and 24 formed in the apertured inner tube construction 18 as perhaps most clearly depicted in FIG. 9A.

The tubular vent assembly or apparatus 10 may further preferably comprise certain thermal insulation means made cooperable with the apertured inner tube construction 18. It is contemplated that the thermal insulation means according to the present invention may effectively function to prevent or slow heat transmission to/from the room interior 100 to/from the room exterior 101 when the apertured inner tube construction 18 is in a closed state as generally depicted in FIGS. 1-3.

In this last regard, it is contemplated that the thermal insulation means may be preferably exemplified by layers of insulation material such as polystyrene foam. More particularly, the thermal insulation means may be defined an upper-exterior layer of material insulation as at 28 and a lower-interior layer of material insulation as at 29. The upper-exterior and lower-interior layers of material insulation 28 and 29 preferably have opposed parallel surfacing as at 30, which opposed parallel surfacing 30 functions to enhance air flow intermediate the room interior 100 and the room exterior 101 when the apertured inner tube construction 18 is in a vent-open state as generally depicted in FIGS. 7-10.

Keeping in line with the notion of outfitting the system or apparatus according to the present invention with certain means for preventing unwanted matter from entering the tubular vent assembly or apparatus 10, it is further contemplated that the present invention may be outfitted a rain or precipitation vent guard as at 31. The rain or precipitation vent guard 31 may be preferably and cooperably associated with the room exterior 101 (as in the case of outdoor room exterior(s) 101, and attached in adjacency to the outer tube-fixing or assembly holding construction (e.g. at or next to the upper tube-engagingassembly 11) for preventing precipitation as at 110 from contacting the tubular vent assembly or apparatus 10.

While the foregoing specifications set forth much specificity, the same should not be construed as setting forth limits to the invention but rather as setting forth certain preferred embodiments and features. For example, as prefaced hereinabove, it is contemplated that the present invention essentially provides a room ventilation apparatus as typified or exemplified by the tubular vent assembly 10 for enabling a user to selectively vent a room or space, which room ventilation apparatus is mountable in a room boundary structure such as a wall or window or door construction for enabling a user to selectively vent a room interior as at 100 to/from a room exterior as at 101.

The tubular vent assembly 10 has an apertured outer tube construction as at 17 and an apertured inner tube construction as at 18. The inner tube construction 18 is rotatable relative to the outer tube construction 17. The outer tube construction comprises room-exterior-side fixed apertures as at 21 and room-interior-side fixed apertures as at 22.

The inner tube construction 18 comprises room-exterior-side rotatable apertures 23 and room-interior-side rotatable apertures 24. The inner tube construction 18 is rotatable relative to the outer tube construction 17 for aligning the rotatable apertures 23 and 24 with the fixed apertures 21 and 22 for selectively enabling an air current to pass to/from the room interior 100 to/from the room exterior 101 for venting the room interior 101.

Stated another way, the present invention may be said to essentially and summarily provide a room ventilation system for enabling a user to selectively ventilate a room, which room ventilation system preferably comprises, in combination, a wall-based, assembly-holding construction and a tubular vent assembly as at 10. The wall-based, assembly-holding construction divides a room interior as at 100 from a room exterior as at 101.

The assembly-holding construction preferably comprises a tube-engaging upper assembly as at 11 and a tube-engaging lower assembly as at 12. The tube-engaging upper assembly 11 preferably comprises downwardly facing inner surfacing as at 15, and the tube-engaging lower assembly preferably comprises upwardly facing inner surfacing as at 16 opposing the downwardly facing inner surfacing.

The tubular vent assembly 10 preferably has or comprises an apertured outer tube construction as at 17 and an apertured inner tube construction as at 18. The apertured outer tube construction 17 preferably has or comprises (a) upwardly facing outer surfacing as at 19; (b) downwardly facing outer surfacing as at 20; (c) room-exterior-side fixed apertures as at 21; and (d) room-interior-side fixed apertures as at 22.

The upwardly and downwardly facing outer surfacing 19 and 20 of the apertured outer tube construction 17 is preferably and respectively shaped for mating with downwardly and upwardly facing inner surfacing 15 and 16 of the tube-engaging upper and lower assemblies 11 and 12. The upwardly facing outer surfacing 19 is thus fixedly attached to the downwardly facing inner surfacing 15, and the downwardly facing outer surfacing 20 is thus fixedly attached to the upwardly facing inner surfacing 16.

The apertured inner tube construction preferably comprises (a) thermal insulation means; (b) room-exterior-side rotatable apertures as at 23; and (c) room-interior-side rotatable apertures as at 24. The apertured inner tube construction 18 is thus rotatable relative to the apertured outer tube construction 17 for aligning the room-exterior-side and room-interior-side rotatable apertures 23 and 24 with the room-exterior-side and room-interior-side fixed apertures 21 and 22 for selectively enabling an air current to pass intermediate the room interior 100 and the room exterior 101 for ventilating the room interior.

The thermal insulation means are preferably defined by an upper layer of material insulation as at 28 and a lower layer of material insulation as at 29. The upper and lower layers of material insulation 28 and 29 preferably have or comprise opposed parallel surfacing as at 30, which opposed parallel surfacing 30 enhances air flow intermediate the room interior 100 and the room exterior 101 when the apertured inner tube construction 18 is in an open state. The thermal insulation means further slow heat transmission intermediate the room interior 100 and the room exterior 101 when the apertured inner tube construction 18 is in a closed state.

The room ventilation apparatus may further preferably comprise certain manually operable means for rotating the inner tube construction 18 relative to the outer tube construction 17 for selectively aligning or opening the tubular vent assembly apertures. In this regard, the outer tube construction 17 comprises a lever-letting slot 26 and the inner tube construction comprises a lever member 25. The lever member 25 extends outwardly from the inner tube construction 18 via the lever-letting slot 26 for enabling the user to selectively align the rotatable apertures 23 and 24 with the fixed apertures 21 and 22 for increasing or decreasing air flow to/from the room interior 100 to/from the room exterior 101.

The room ventilation apparatus may further preferably comprise certain aperture-filtering means cooperably associated with either the fixed or rotatable apertures for preventing matter from entering the inner space defined by the inner tube construction. Although the aperture-filtering means as defined by the screen structures 27 have been illustrated in the drawings submitted in support of these specifications as extending across the rotatable apertures 23 and 24, the screen structures 27 may just as easily extend across the fixed apertures 21 and 22 and still be within the spirit of the present invention.

The room ventilation apparatus according to the present invention may further preferably comprise certain thermal insulation means for preventing or slowing heat transmission to/from the room interior 100 to/from the room exterior 101 when the inner tube construction 18 is in a closed state. The thermal insulation means are exemplified by an upper-exterior layer of material insulation as at 28 and a lower-interior layer of material insulation as at 29. The upper-exterior and lower-interior layers of material insulation 28 and 29 preferably comprise opposed parallel surfacing as at 30 for enhancing air flow intermediate the room interior 100 and the room exterior 101 when the inner tube construction is in a vent-open state.

In addition to the various structural aspects of the invention, it is believed that the foregoing specifications further support certain room ventilation methodological advancements or certain methods for ventilating a room. In this regard, the room ventilation method according to the present invention is believed to enable a user to selectively vent a room, and essentially comprises the initial step of forming an assembly-holding construction in a room boundary structure.

The assembly-holding construction preferably comprises an upper tube-engaging assembly and a lower tube-engaging assembly. The tubular vent assembly or apparatus 10 may then be mounted in the assembly-holding construction, which tubular vent assembly has an apertured outer tube construction and an apertured inner tube construction. The outer tube construction is rotatively fixed relative to the assembly-holding construction and comprises room-exterior-side fixed apertures and room-interior-side fixed apertures.

The inner tube construction may then be selectively rotated relative to the outer tube construction. The inner tube construction comprises room-exterior-side rotatable apertures and room-interior-side rotatable apertures. The rotatable and fixed apertures may be selectively aligned for enabling an air current to pass intermediate the room interior 100 and the room exterior 101 for venting the room interior 100.

It has been noted that the step of selectively rotating the inner tube construction relative to the outer tube construction may be performed manually. More particularly, the outer tube construction comprises a lever-letting slot 26 and the inner tube construction comprises a lever member 25. The lever member 25 extends outwardly from the inner tube construction via the lever-letting slot 26, and the method may thus be said to further comprise the step of manually aligning the rotatable apertures with the fixed apertures for increasing or decreasing air flow from the room interior to the room exterior via the lever member 25.

The room ventilation method may further comprise the step of filtering air as it flows through the tube vent assembly or apparatus according to the present invention via certain aperture-filtering means cooperably associated with the inner tube rotatable apertures 23 and 24 or outer tube fixed apertures 21 and 22 or a combination thereof. The aperture-filtering means basically function to prevent matter (such as debris or insects) from entering the inner space defined by the tubular vent assembly or apparatus 10.

The room ventilation method may further comprise the step of preventing precipitation from contacting the tubular vent assembly or apparatus via certain precipitation vent-guarding means as exemplified the guard element 31. The vent-guarding means are preferably and cooperably associated with the room exterior and attached in adjacency to the assembly-holding construction.

The room ventilation method may further comprise the step of thermally insulating the tubular vent assembly or apparatus for preventing or slowing heat transmission intermediate the room interior 100 and the room exterior 101 when the inner tube construction is in a closed state. Airflow may be directed intermediate opposed parallel surfacing defined by the tubular vent assembly for enhancing air flow intermediate the room interior and room exterior when the inner tube construction is in a vent-open state.

Accordingly, although the present invention has been described by reference to certain preferred arrangements and certain methodologies, it is not intended that the novel arrangements and methods be limited thereby, but that modifications thereof are intended to be included as falling within the broad scope and spirit of the foregoing disclosures, the following claims, and the appended drawings.

I claim:

1. A room ventilation system for enabling a user to selectively ventilate a room, the room ventilation system comprising, in combination:

a wall-based, assembly-holding construction, the wall-based, assembly-holding construction dividing a room interior from a room exterior, the assembly-holding construction comprising a tube-engaging upper assembly and a tube-engaging lower assembly, the tube-engaging upper assembly comprising downwardly facing inner surfacing, the tube-engaging lower assembly comprising upwardly facing inner surfacing opposing the downwardly facing inner surfacing; and a tubular vent assembly, the tubular vent assembly having an apertured outer tube construction and an apertured inner tube construction, the apertured outer tube construction having upwardly facing outer surfacing, downwardly facing outer surfacing, room-exterior-side fixed apertures and room-interior-side fixed apertures, the upwardly and downwardly facing outer surfacing of the apertured outer tube construction being respectively shaped for mating with downwardly and upwardly facing inner surfacing of the tube-engaging upper and lower assemblies, the upwardly facing outer surfacing thus being fixedly attached to the downwardly facing inner surfacing, and the downwardly facing outer surfacing thus being fixedly attached to the upwardly facing inner surfacing, the apertured inner tube construction comprising thermal insulation means, room-exterior-side rotatable apertures and room-interior-side rotatable apertures, the apertured inner tube construction being rotatable relative to the apertured outer tube construction for aligning the room-exterior-side and room-interior-side rotatable apertures with the room-exterior-side and room-interior-side fixed apertures for selectively enabling an air current to pass intermediate the room interior and the room exterior for ventilating the room interior, the thermal insulation means being defined by an upper layer of material insulation and a lower layer of material insulation, the upper and lower layers of material insulation having opposed parallel surfacing, the opposed parallel surfacing for enhancing air flow intermediate the room interior and the room exterior when the apertured inner tube construction is in an open state, the thermal insulation means for slowing heat transmission intermediate the room interior and the room exterior when the apertured inner tube construction is in a closed state.

2. The room ventilation system of claim 1 comprising manually operable means for rotating the apertured inner tube construction relative to the apertured outer tube construction for selectively aligning the room-exterior-side and room-interior-side rotatable apertures and room-exterior-side and room-interior-side fixed apertures.

3. The room ventilation system of claim 2 wherein the apertured outer tube construction comprises a lever-letting slot and the apertured inner tube construction comprises a lever member, the lever member extending outwardly from the apertured inner tube construction via the lever-letting slot, the lever member for enabling the user to selectively align the room-exterior-side and room-interior-side rotatable apertures and room-exterior-side and room-interior-side fixed apertures for increasing or decreasing air flow intermediate the room interior and the room exterior.

4. The room ventilation system of claim 1 wherein the tubular vent assembly comprises aperture-filtering means cooperably associated therewith for preventing matter from entering the tubular vent assembly.

5. The room ventilation system of claim 1 comprising vent-guarding means, the vent-guarding means being cooperably associated with the assembly-holding construction at the tube-engaging upper assembly for preventing precipitation from contacting the tubular vent assembly.

* * * * *